US006348100B1

(12) United States Patent
Cummings et al.

(10) Patent No.: US 6,348,100 B1
(45) Date of Patent: Feb. 19, 2002

(54) RESIST BOWL CLEANING

(75) Inventors: Scott A. Cummings, Jeffersonville; Dennis P. Hogan, Jericho; Alfred A. Rouleau, III, Jonsville, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/346,218

(22) Filed: Jul. 1, 1999

(51) Int. Cl.[7] ..... B08B 3/12; B08B 3/08; C23G 1/02

(52) U.S. Cl. ..... 134/1; 134/1.3; 134/27

(58) Field of Search ..... 134/1.3, 1, 3, 26, 134/27, 28, 30; 510/165, 175, 176, 243, 244, 435

(56) References Cited

U.S. PATENT DOCUMENTS 3,871,929 A * 3/1975 Schevey et al. ..... 134/3
5,091,103 A * 2/1992 Dean et al. ..... 510/175
5,098,594 A * 3/1992 Doscher ..... 134/1
5,352,329 A 10/1994 Herbert et al. ..... 134/3
5,378,315 A 1/1995 Hendrix et al. ..... 134/3
5,690,747 A * 11/1997 Doscher ..... 134/1
5,855,811 A * 1/1999 Grieger et al. ..... 134/1.3
5,989,353 A * 11/1999 Skee et al. ..... 134/2

FOREIGN PATENT DOCUMENTS

JP 57050454 3/1982

OTHER PUBLICATIONS

Eisenmann, D.E., et al., "Prewire Bond Etch", *IBM Technical Disclosure Bulletin*, vol. 18, No. 8, Jan. 1976, p. 2590.
"Glacial Acetic Acid Stripper In Semiconductor Manufacturing Process", *IBM Technical Disclosure Bulletin*, vol. 28, No. 4, Sep. 1985, p. 1810.

* cited by examiner

*Primary Examiner*—Randy Gulakowski
*Assistant Examiner*—Saeed Chaudhry
(74) *Attorney, Agent, or Firm*—Connolly Bove Lodge & Hutz, LLP; James M. Leas

(57) ABSTRACT

A method of processing a substrate. A polymer is applied to a substrate. A portion of the polymer is not retained on the substrate and is collected by a catch basin. The catch basin is cleaned by exposing the catch basin and collected polymer to a material comprising acetic acid.

32 Claims, 1 Drawing Sheet

RESIST BOWL CLEANING

FIELD OF THE INVENTION

The invention relates to a process for cleaning elements of apparatuses utilized in semiconductor structure manufacturing. In particular, the present invention relates to processes for removing photoresists from devices for depositing the photoresists on semiconductor substrates.

BACKGROUND OF THE INVENTION

In the process of manufacturing semiconductor structures, materials used in the manufacturing can be deposited on devices utilized in the manufacturing processes. Typically it is desirable to remove residues of materials from manufacturing devices for a variety of reasons including facilitating proper functioning of the manufacturing devices as well as to prevent contamination of articles subsequently manufactured in those devices.

However, it may not always be easy to remove materials deposited on the semiconductor manufacturing devices. For example, many materials may be resistant to solvents, etching and/or other processes utilized in cleaning the manufacturing devices. Furthermore, processes for cleaning the manufacturing devices may create problems of generating undesirable wastes and utilizing hazardous materials, such as solvents. Also, cleaning methods require time, money, manpower and materials to carry out.

One example of where materials are undesirably deposited on manufacturing device and require removal involves spin coating photoresist on a semiconductor substrate. FIG. 1 illustrates one example of a spinning tool with a catch basin utilized in the spin coating operations. Typically, photoresists are deposited by spin coating. However, other materials could be spun coated on a substrate.

The device illustrated in FIG. 1 includes a solvent/polymer mixture source 1. As indicated in FIG. 1, the solvent/polymer mixture typically is applied from above. A substrate 3 may be arranged on a substrate support 11. As indicated by arrows 5 and 15, the substrate support and, consequently, the substrate arranged thereon may be spun by shaft 13 as the material is applied to the substrate.

As the substrate spins, some of the material typically flies off of the substrate as a result of centrifugal forces as indicated by arrow 7. The device illustrated in FIG. 1 includes a catch basin 9 where excess material that is spun off the substrate is deposited. As a result, the catch basin 9 may help to eliminate contamination of the environment surrounding the catch basin and the spinning substrate. In the context of spin coating on of photoresist the catch basin may be referred to as a resist bowl. Typically, the resist bowl is made of plastic or other materials.

However, as the material being applied to the substrate is deposited in the catch basin, it creates a problem of cleaning the catch basin. The exhaust and/or drain ports 11 may be provided in the catch basin to help remove the build up of material. Along these lines, a drain line (not shown) could be attached to the exhaust/drain ports 11. Furthermore, a vacuum source to help encourage removal of material from the catch basin could be interconnected with the exhaust/drain ports.

SUMMARY OF THE INVENTION

The present invention provides a cleaning method including providing a surface with a polymer thereon. A cleaning material including acetic acid is applied to surface and the polymer. The surface and the polymer are exposed to ultrasonic energy at a temperature about room temperature to remove the polymer.

The present invention also includes a method of processing a substrate. The method includes applying a polymer to a substrate, wherein a portion of the polymer is not retained on the substrate and is collected by a catch basin. The catch basin is cleaned by exposing the catch basin to collect the polymer and to a cleaning material including acetic acid.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Figure 1:
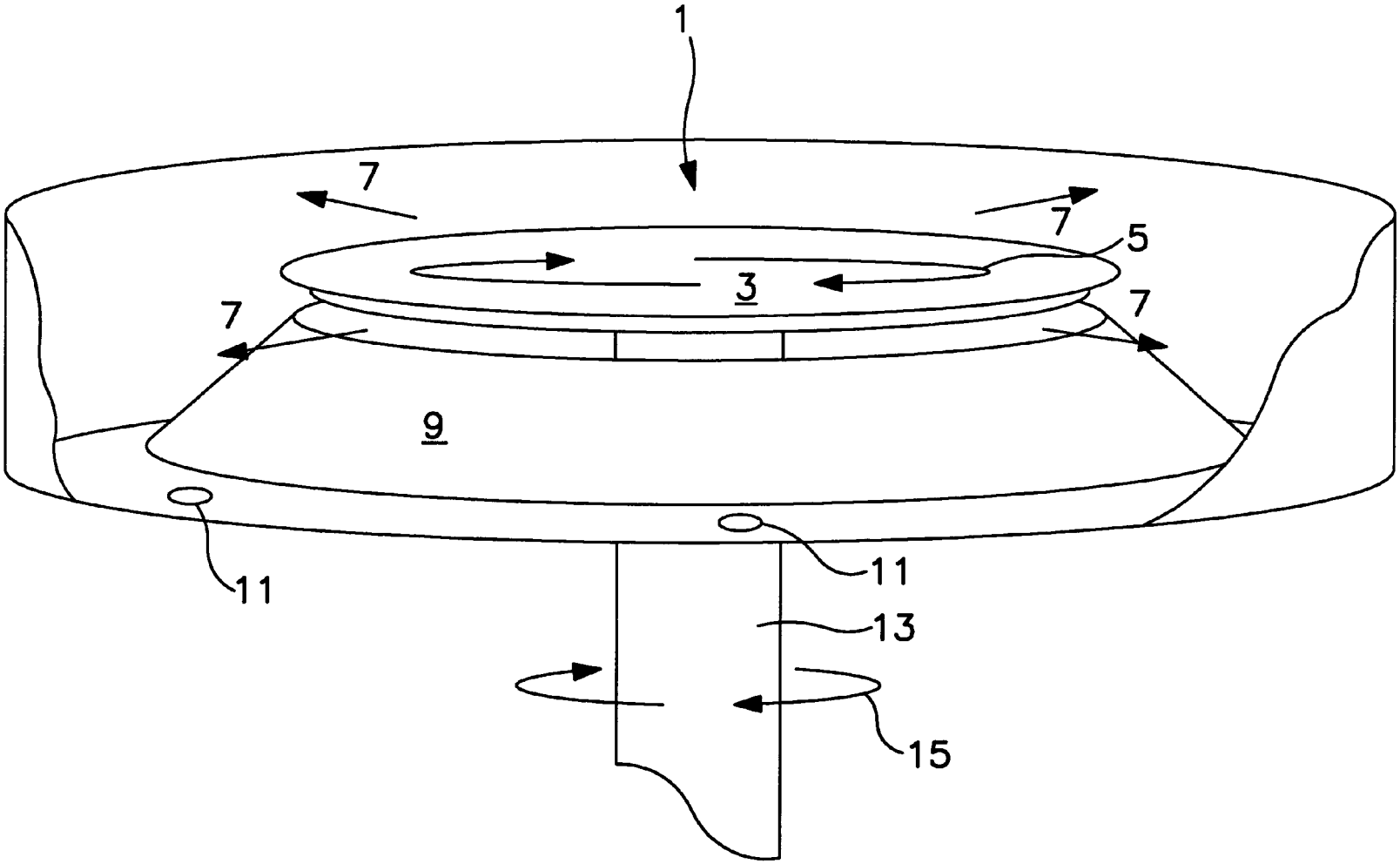
FIG. 1 represents a perspective partial cut-away view of an example of a device for spin coating photoresist onto semiconductor wafers.

As stated above, semiconductor structure manufacturing processes can result in deposition of materials on processing apparatuses. The spin coating of resist is one such process. Cleaning a resist bowl utilized in spin coating resist or any other process currently typically involves the use of solvents in fairly large quantities. Such solvents include n-butyl acetate, cyclohexanone, isopropyl alcohol and propyleneglycolmethyletheracetate (PGMA). However, such solvents can be costly, are themselves health and environmental hazards, and must be disposed of. As a result, there are many negative issues associated with the use of solvents in cleaning.

In the context of resist bowl cleaning, materials deposited on the resist bowl can include films consisting of crosslinked, non-cross-linked, and/or partially crosslinked resins. The resins can include phenolic resins, including novolak resins including cresol novolak resin. the resins can also include polyhydroxyl styrene resins and polysulfone resins. The resins may or may not include photo and/or thermal sensitive additives.

In one particular example, the materials deposited on a resist bowl can include photoresist. For example, positive and negative photoresists as well as mid-UV and deep-UV photoresists and others may be deposited on a resist bowl.

Other materials that can be deposited in the resist bowl include non-photosensitive anti-reflective coatings. Also, top coat resin and resist stripping residues may be deposited on a resist bowl.

Typically, the cleaning is carried out so that the resist bowl or other device may be reused.

Photoresists and anti-reflective coatings can be very stubborn to remove, resisting even the action of the above described solvents. Anti-reflective coatings may be particularly difficult or "stubborn" to remove from semiconductor manufacturing devices. This may be because they are not photosensitive. Lacking photosensitive groups may make a material less reactive and therefore more difficult to remove. Also, since anti-reflective coatings are designed to crosslink on a semiconductor wafer when baked out, it is likely that some crosslinking may occur in dried up anti-reflective coating residue on semiconductor manufacturing devices.

There are a few other options for removing the materials deposited on the resist bowl or any other semiconductor processing device. Other processes that are being explored or utilized may include utilizing frozen carbon dioxide to freeze photoresist and fracture it off of cleaning bowls. However, this is very labor intensive with ergonomic concerns damage to the semiconductor manufacturing devices and typically realizes only a small savings over solvent methods. Such savings could be quickly offset by having to replace damaged manufacturing devices. Additionally, such methods would generally still require at least one solvent wipe down step.

It has been discovered according to the present invention that a cleaning material including glacial acetic acid may be utilized to clean semiconductor manufacturing devices, in particularly resist bowls, effectively, cheaper and cleaner than solvents typically utilized in such cleaning processes. The cleaning material utilized according to the present invention includes highly concentrated acetic acid. Typically, the acetic acid is glacial acetic acid, commonly defined as being about 99.8% pure. However, the acetic acid utilized according to the present invention may be less concentrated. Along these lines, acetic acid having a concentration of at least about 95% may be utilized according to the present invention. Typically, the acetic acid has a concentration of at least about 80%.

In some embodiments, a cleaning process according to the present invention simply includes exposing a semiconductor manufacturing device to the acetic acid. The acetic acid may be applied in any manner. For example, it could be sprayed on. Alternatively, the semiconductor manufacturing device could be immersed in the acetic acid.

The semiconductor manufacturing device materials to be removed therefrom may be exposed to the acetic acid for a period of time. Along these lines, the exposure may be carried out for a time of about 15 minutes to about 18 hours. Typically, the exposure time is about 15 minutes to about 3 hours. More typically, the exposure is carried out for about 30 minutes to about 60 minutes.

One factor that may influence the exposure time is the characteristics of the material being removed. Along these lines, thin coatings of photoresist could be removed utilizing an exposure time of about 15 minutes. On the other hand, heavy coatings of cross-linked polymer could require exposure of more than about 2 hours.

The cleaning may take place at a temperature or a range of temperatures that help to encourage the removal of materials from the semiconductor manufacturing device by the cleaning material. According to some embodiments, the cleaning may be performed at a temperature of about room temperature. The cleaning may also take place at temperatures elevated above room temperature. For example, the cleaning could take place at a temperature of up to about 40° C. The cleaning could take place at a temperature anywhere between about room temperature and about 40° C. The cleaning could also take place at a temperature less than room temperature. Typically, the cleaning is performed at a temperature of less than a flash point of the cleaning material.

Elevated temperatures may be utilized in the cleaning method according to the present invention whether the semiconductor manufacturing device is immersed in the cleaning material or the cleaning material is sprayed on. In the event that the semiconductor manufacturing device is immersed in the cleaning material, the cleaning material may be heated. Even if it is sprayed on, it can be sprayed on in a heated state.

During the exposure of the semiconductor manufacturing device and material to be removed therefrom to the cleaning material, the semiconductor manufacturing device and material to be removed therefrom may be exposed to ultrasonic energy.

Ultrasonic energy may be particularly useful because it may cause material to be removed to swell thereby making it more prone to removal by physical agitation. Materials that are not soluble in acetic acid and particularly highly concentrated acetic acid may be removed by utilizing ultrasonic energy and/or physical agitation as well as the acetic acid.

If the cleaning method according to the present invention includes utilizing ultrasonic energy, the ultrasonic energy may have a frequency of about 40 kHz to about 60 kHz. However, ultrasonic energy having any frequency may be utilized. The ultrasonic energy may help to physically loosen the material being removed from the semiconductor manufacturing device.

Prior to, during, or after exposure to the cleaning material of the semiconductor manufacturing device and material to be removed therefrom, the material to be removed may be physically agitated. Typically, the physical agitation takes place after exposure to the cleaning material. The physical agitation can include wiping the material to be removed from the catch basin. The wiping may take place with any sort of material, such as a woven or non-woven fabric made of natural and/or artificial material.

The material utilized in the physical agitation may also have abrasive properties. For example, steel wool or abrasive pad could be utilized. Physical agitation of the material to be removed may also or alternatively include using a brush or scraper. Typically, if the material utilized in the physical agitation is abrasive, it is not so abrasive that it will physically damage the semiconductor manufacturing device.

After exposing the semiconductor manufacturing device and material to be removed therefrom to the cleaning material, the semiconductor manufacturing device may be rinsed. The rinsing may take place regardless of whether elevated temperatures, ultrasonic energy, or physical agitation and/or any other additional process steps are utilized. While any material may be utilized to rinse the semiconductor manufacturing device, typically, water is utilized. Further typically, the water is deionized water.

In addition to acetic acid, the cleaning material according to the present invention may include tetramethyl ammonium hydroxide (TMAH). A TMAH solution may include up to about 10% TMAH. Typically, the solution includes about 3% to about 5% TMAH. The solvent in such solutions may be water. According to one embodiment, deionized water is utilized.

Typically, the step including exposing the material to be removed to the cleaning material including TMAH may include an additional step of exposing the material to be removed to a solution including TMAH after exposure to the cleaning material that includes acetic acid. The TMAH may help to neutralize the acetic acid. Typically, the TMAH containing cleaning material is a mild TMAH solution. Such a solution may have the same characteristics as the TMAH solution described above.

The TMAH solution may be sprayed on the semiconductor manufacturing device. Alternatively, semiconductor manufacturing device may be immersed in the TMAH solution.

According to some embodiments, the material to be removed from the semiconductor manufacturing device may be exposed to different solutions having different compositions at different times during the cleaning process. Additionally, a process according to the present invention could include more than one exposure to the cleaning material. For example, the material to be removed could be exposed to the cleaning material. The material to be removed could then be physically agitated. The material to be removed could then again be exposed to the cleaning material. Any of the periods that the material to be removed is exposed to the cleaning material may include application of ultrasonic energy.

After the cleaning has been carried out, the semiconductor manufacturing device may be dried. The drying may be carried out by exposing the semiconductor manufacturing device to temperatures above room temperature. For example, the drying could be carried out at temperatures up to about 80° C. for plastic substrates and up to about 125° C. for metallic substrates. Rather than drying by being exposed to elevated temperatures, the semiconductor manufacturing device could simply be air-dried.

As stated above, the material to be removed from the semiconductor manufacturing device may include a variety of materials. The materials could include photoresist, anti-reflective coatings and/or other organic films or coatings.

The materials to be removed may have low solubilities in the solvents described herein that are currently typically used for cleaning semiconductor manufacturing devices. Typically, the semiconductor manufacturing devices are cleaned periodically throughout their useful life. The cleaning can take place at any interval. Typically, the cleaning takes place when the semiconductor manufacturing device may not be efficiently used or materials on the semiconductor manufacturing device could contaminate the semiconductor wafer(s) being processed therein. However, the cleaning may take place at any time.

The cleaning method according to the present invention may be part of an overall method of processing a substrate. Such a method may include applying a polymer to a substrate. The polymer may be applied by spin coating. Typically, the polymer(s) applied to the substrate as part of a solvent and polymer mixture. The solvent-polymer mixture may be a photoresist.

A portion of the polymer may not be retained by the substrate. If the polymer is being spun on the substrate, the material not retained on the substrate may be spun off of the substrate. Material not remaining on the substrate may be collected on the semiconductor manufacturing device. According to some embodiments, material not remaining on the substrate is collected by a catch basin.

The semiconductor manufacturing device or portion thereof may be cleaned utilizing the method according to the present invention. If the material not retained by the substrate is collected by a catch basin, the present invention could include exposing the catch basin and material collected therein to a cleaning material according to the present invention. The cleaning material and cleaning process may be substantially as described above.

The extremely polar nature of glacial acetic acid may make it more compatible with resist solutions making it more likely to dissolve the resist solutions with anti-reflective coatings that may be very resilient crosslink polymers, the acetic acid as well as the ultrasonic energy and heat may also help to swell the anti-reflective coatings making them more susceptible to removal. It may be very important to utilize an acetic acid solution that includes only very small amounts of water. This may be because the materials being removed are typically insoluble in water.

The present invention offers a variety of advantages over currently used solvents as well as other techniques utilized for cleaning semiconductor manufacturing devices and, in particular, resist bowls utilized in spin coating photoresists. For example, a given quantity of acetic acid can last longer and clean more apparatuses and, in particular, resist bowls, per gallon than the typically utilized solvents. This results in an overall cost savings in chemical purchases and reduced waste.

According to one estimate, the present invention can result in a cost savings of about 86% as compared to the cost of solvents. This cost savings does not include any additional cost savings achieved by not requiring special handling of solvents. Significantly, by utilizing acetic acid, tens of thousands of gallons of costly and environmental and health damaging solvents can be eliminated. As referred to above, there may also be achieved an elimination or great reduction in disposal costs when utilizing acetic acid as compared to the typically utilized solvents.

Of course, the dollar savings as well as reduction in solvents can vary from installation to installation. According to one example, 250,000 dollars could be saved and 54,000 gallons of solvent eliminated. In another application, 1.2 million dollars could be saved and about 186,000 gallons of acetone solvent eliminated. In one application, about 3,000 gallons per year of acetic acid may be utilized in place of about 54,000 gallons per year of solvents.

Additionally, while the above referred to solvents are relatively exotic materials as compared to acetic acid, acetic acid is a common material utilized in floor cleaners, vinegar, and other applications. Acetic acid does not require specialized treatment systems and is not targeted by government for reduced use as are many of the above solvents. After acetic acid utilized in a process according to the present invention is neutralized, the remaining organic component is common and compatible with bacteria utilized to break down waste in standard waste systems. Additionally, acetic acid has a lower volatility and/or flammability than most solvents. While acetic acid is a contact hazard, its overall toxicity is very low.

Additionally when utilizing acetic acid, capital costs are significantly less than for a solvent system requiring equipment to distribute and collect solvent. Additionally, there is no need for a scrubbed exhaust when utilizing acetic acid.

While aqueous strippers may not be very effective especially against ARC's or non-exposed positive resist, acetic acid is effective in removing such materials. Also, aqueous resist strippers are often not compatible with metals. On the other hand, glacial acetic acid is compatible with stainless steel fittings on parts to be cleaned. Also, acetic acid does not include metals, such as potassium or sodium, to potentially contaminate processes as many aqueous resist strippers do. Also, TMAH can be utilized to aid in the rinsing process if residual acetic acid is concerned. However, this may not be necessary.

In the past, acetic acid may not have been utilized because it is not a standard organic solvent, such as alcohol or N-butyl acetate (NBA). Additionally, acetic acid is not a standard acid utilized in semiconductor manufacturing processes or associated processes, such as cleaning, as other acids are, such as sulfuric acid. Established cleaning methods utilizing acetic acid typically utilized aqueous solutions. As discussed above, aqueous solutions may not be effective in cleaning semiconductor manufacturing devices, such as resist bowls, utilized in spin coating resist. Glacial acetic acid is a good universal, readily available, cheap, manageable, treatable and relatively non-hazardous solution to clean semiconductor manufacturing devices.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. A method of processing a substrate, the method comprising:

applying a polymer to a substrate, wherein a portion of the polymer is not retained on the substrate and is collected by a catch basin;

cleaning the catch basin by exposing the catch basin and collected polymer to a material comprising acetic acid, wherein the cleaning further comprises exposing the catch basin and collected polymer to ultrasonic energy; and after exposure to acetic acid, exposing the catch basin, the acetic acid, and the collected polymer to a solution containing TMAH, wherein the TMAH solution at least partially neutralizes the acetic acid.

2. The method according to claim 1, wherein the material comprises at least about 95% acetic acid.

3. The method according to claim 1, wherein the material is glacial acetic acid.

4. The method according to claim 1, wherein the material comprises at least about 80% acetic acid.

5. The method according to claim 1, wherein the polymer is photoresist.

6. The method according to claim 1, wherein the polymer has a low solubility.

7. The method according to claim 1, wherein the cleaning is performed at a temperature of less than about 40° C.

8. The method according to claim 1, wherein the cleaning is performed at a temperature of less than a flash point of the material.

9. The method according to claim 1, wherein the cleaning is performed at room temperature.

10. The method according to claim 1, wherein the ultrasonic energy has a frequency of about 40 kHz to about 60 kHz.

11. The method according to claim 10, further comprising the step of rinsing the catch basin in water after the cleaning.

12. The method according to claim 10, further comprising the step of rinsing the catch basin in deionized water after the cleaning.

13. The method according to claim 1, wherein the cleaning further comprises physically agitating the polymer after exposure to the material.

14. The method according to claim 13, wherein the physical agitation comprises wiping collected polymer from the catch basin.

15. The method according to claim 1, wherein the catch basin and the collected polymer are dipped into the material.

16. The method according to claim 1, wherein the material is sprayed onto the catch basin and the collected polymer.

17. The method according to claim 1, further comprising the step of rinsing the catch basin in water after the cleaning.

18. The method according to claim 17, further comprising:

drying the catch basin by exposing the catch basin to elevated temperature after the cleaning.

19. The method according to claim 1, further comprising the step of rinsing the catch basin in deionized water after the cleaning.

20. The method according to claim 1, wherein the catch basin and the collected polymer are exposed to the material for about 30 minutes to about 1 hour.

21. The method according to claim 1, wherein the polymer is spun on the substrate and the polymer not retained by the substrate is spun off of the substrate.

22. The method according to claim 1, wherein the catch basin is cleaned periodically.

23. The method according to claim 1, wherein the polymer comprises anti-reflective coating.

24. The method according to claim 1, further comprising at least one treatment selected from the group consisting of exposing the catch basin and the collected polymer to temperature above room temperature, exposing the catch basin and collected polymer to ultrasonic energy, physically agitating the collected polymer after exposure to the material, and rinsing the catch basin in water after the cleaning.

25. A method of processing a substrate, the method comprising:

applying a polymer to a substrate, wherein a portion of the polymer is not retained on the substrate and is collected by a catch basin;

cleaning the catch basin by exposing the catch basin and collected polymer to a material comprising acetic acid; and exposing the catch basin and the collected polymer to a solution comprising TMAH after said cleaning the catch basin step, wherein the TMAH solution at least partially neutralizes the acetic acid.

26. A method of cleaning, comprising:

providing a surface with a polymer thereon;

applying a material comprising at least about 95% acetic acid to the surface and the polymer; and exposing the surface, the acetic acid, and the polymer to ultrasonic energy at a temperature about room temperature to remove the polymer.

27. The method according to claim 26, wherein the polymer comprises part of a solvent and polymer mixture.

28. The method according to claim 27, wherein the solvent polymer mixture is photoresist.

29. The method according to claim 27, wherein the surface is a surface of a spinning tool.

30. The method according to claim 29, wherein the surface of the spinning tool is a surface of a catch basin.

31. The method according to claim 26, wherein the ultrasonic energy has a frequency of about 40 kHz to about 60 kHz.

32. The method according to claim 26, wherein the acetic acid is glacial acetic acid.

* * * * *